United States Patent [19]

Scruggs et al.

[11] Patent Number: 4,648,820

[45] Date of Patent: Mar. 10, 1987

[54] APPARATUS FOR PRODUCING RAPIDLY QUENCHED METAL PARTICLES

[75] Inventors: David M. Scruggs, San Juan Capistrano; Eric N. Mickelson, Mission Viejo, both of Calif.

[73] Assignee: Dresser Industries, Inc., Dallas, Tex.

[21] Appl. No.: 797,925

[22] Filed: Nov. 14, 1985

[51] Int. Cl.[4] ..... B22F 9/10

[52] U.S. Cl. ..... 425/8; 264/8

[58] Field of Search ..... 425/8, 10, 6; 264/8, 264/11, 5, 12

[56] References Cited

U.S. PATENT DOCUMENTS

| | | | |
|---|---|---|---|
| 1,560,527 | 11/1925 | Bassler | 425/8 X |
| 2,439,772 | 4/1948 | Gow | 264/8 |
| 2,773,840 | 12/1956 | Drew | 425/10 X |
| 2,897,539 | 8/1959 | McMillan | 264/8 |
| 3,397,257 | 8/1968 | Brambilla et al. | 264/5 |
| 3,797,978 | 3/1974 | Young et al. | 264/8 X |
| 4,207,040 | 6/1980 | Metcalfe et al. | 425/8 |
| 4,284,394 | 8/1981 | Thompson | 425/8 |
| 4,374,074 | 2/1983 | Ueda et al. | 264/8 |
| 4,375,440 | 3/1983 | Thompson | 264/12 |
| 4,377,375 | 3/1983 | Slaughter | 425/8 |
| 4,426,337 | 1/1984 | Suzuki et al. | 425/6 X |
| 4,490,601 | 12/1984 | Yokoyama | 425/6 X |

FOREIGN PATENT DOCUMENTS

| | | | |
|---|---|---|---|
| 785290 | 10/1957 | United Kingdom | 425/8 |

OTHER PUBLICATIONS

Article from *Journal of Metals*, Apr. 1984, entitled "Production of Rapidly Solidified Metals and Alloys", S. J. Savage and F. H. Froes.

*Primary Examiner*—Richard L. Chiesa
*Attorney, Agent, or Firm*—Gregory O. Garmong; William R. Peoples

[57] ABSTRACT

Apparatus for continuous preparation of rapidly cooled metal particles from a molten source metal by quenching into a quench liquid, wherein a cylindrical quench chamber rotates about its axis to hold the quench liquid against the inner wall thereof under centrifugal force, and a spinner disk within the quench chamber rotates about the same axis to spin off molten metal droplets into the quench liquid. Quench liquid is supplied at one end of the quench chamber and removed at the other end continuously, at the same time drawing off the solidified metal particles to an external recirculation loop where the particles are separated from the quench liquid. The spinner disk has an upper surface including a generally conical protruding tip. Metal from a source metal supply tube is directed downwardly onto the apex of the tip to form a laminar flow along the upper surface of the spinner disk. Droplets are formed near the outer periphery of the spinner disk as the liquid source metal is thrown off the disk, so that the time between formation of the liquid drops and their impingement on the wall of quench liquid is very brief. Consequently, the liquid droplets are cooled very rapidly, achieving cooling rates on the order of $10^7$° C. per second.

13 Claims, 11 Drawing Figures

APPARATUS FOR PRODUCING RAPIDLY QUENCHED METAL PARTICLES

BACKGROUND OF THE INVENTION

This invention relates generally to the production of metal particles such as powders, and, more particularly, to the continuous production of rapidly cooled metal particles.

In many cases, rapidly cooled metallic particles or powders have highly desirable properties. Some metals, when cooled at rates of about $10^{5°}$ C. per second or greater, retain the amorphous structure of the liquid into the solid state. Studies have shown that articles formed from such amorphous materials can combine strength, ductility, corrosion resistance, wearresistance, and other highly desirable features. Other metals rapidly cooled from the liquid state may not be amorphous, but nevertheless have very fine microstructures with an almost total absence of undesirable macroscopic segregation. Such rapidly solidified crystalline powders also exhibit highly desirable metallurgical, mechanical and chemical properties.

To make effective use of the properties of rapidly solidified metal particles, it is necessary in most instances that they be consolidated as by powder metallurgical techniques, into larger parts, and such techniques are known. As the processing of rapidly solidified particles into articles has become more commonplace, there has been an increased demand for large quantities of such particles. There therefore exists a continuing need for apparatus and techniques for producing quantities of rapidly solidified, controllably sized, metal particles of high purity.

Numerous techniques have been developed to produce rapidly solidified materials. The earliest techniques involved propelling a molten mass against a cold surface to "splat cool" the metal. Another approach was to place a droplet of liquid metal between two anvils and bring the anvils together. Both of these techniques are operable for laboratory scale work, but are not sufficiently continuous to produce the high volumes of particles necessary to meet current demands.

Larger volumes of rapidly solidified metal powders are ordinarily produced by atomization processes. As an example, in two-fluid atomization a stream of the molten metal to be atomized is impacted by a second stream of a high velocity fluid which causes droplet formation. The atomizing second fluid can be either a gas such as nitrogen or a liquid such as water. The maximum cooling rate of powders produced by gas atomization is typically about $10^{3°}$ C. second, while water atomized particles have cooling rates of as high as about $10^{4°}$ C. per second. Ultrasonic gas atomization is a newer technique wherein shockwave tubes produce gas pulses that atomize a metal stream, to yield cooling rates as high as $10^{6°}$ C. per second. Many unsolved problems remain in adapting such techniques to commercial operations, including maintaining the desired purity of the powder material.

A promising technique for producing commercial quantities of metallic particles at high solidification rates employs centrifugal force to atomize liquids. In one such approach, a molten metal stream is directed toward the center of a rapidly rotating disk, and particles are produced as the liquid is atomized on the disk and thrown outwardly by centrifugal force. The atomized liquid droplets can then be rapidly cooled by convection, an impinging gas stream, or quenching into a liquid. One approach to providing the quench liquid is to place the liquid into a rapidly rotating cup. Centrifugal force causes the liquid to form a layer around the inner wall of the cup, to quench the particles as they impact the surface of the liquid layer. Current techniques of this type can produce cooling rates as high as about $10^{6°}$ C. per second.

Centrifugal atomization techniques are promising candidates for commercial production of rapidly solidified powders, but as yet have not achieved their full potential for several reasons. First, no convenient, economical, continuous process has been proposed. Second, there is no approach for achieving cooling rates greater than about $10^{6°}$ C. per second, even in very fine particles. Higher cooling rates offer the potential of producing new amorphous particles requiring such higher cooling rates, producing more rapidly solidified crystalline particles, and producing high purity, rapidly solidified particles of larger sizes and of shapes having greater utility in powder compaction techniques than do typical spherical particles.

There exists a continuing need for an improved apparatus and process for producing rapidly solidified metal particles, in commercial production quantities and in a continuous fashion. Such an apparatus would preferably be highly versatile, to allow the production of many types of metal particles, using a wide variety of quenchants, and in a variety of operating environments such as vacuum, liquids, or gases. The present invention fulfills this need, and further provides related advantages.

SUMMARY OF THE INVENTION

The present invention resides in an improved centrifugal atomization technique for the continuous production of metal particles from a source of molten metal. A very rapid quenching is achieved by arranging for a short time of flight between droplet formation and contact of the droplet with the quench medium. The quench medium is continuously flowed through the system, carrying away the solidified metal particles for subsequent separation from the liquid quench medium.

In accordance with the invention, an apparatus for preparing metal particles from a molten source metal comprises a housing having a cylindrical hollow internal quench chamber, the quench chamber having an inwardly directed flange at each end thereof to define a liquid retention volume for holding a quench liquid, the quench chamber being rotatable about its cylindrical axis; a spinner disk within said housing having an upper surface and a generally conical protruding portion forming at least a part of the upper surface, the spinner disk being rotatable on the same axis as the quench chamber; a source metal supply tube positioned to deposit molten source metal substantially in the center of the upper surface of the disk, whereupon the molten source metal is thrown outwardly into the quench liquid; means for supplying quench liquid to the liquid retention volume at one end; and means for continuously removing quench liquid and solidified particles mixed with the quench liquid from the other end of the liquid retention volume.

In operation, the quench chamber is rotated about its cylindrical axis, and quench liquid is added to the liquid retention volume to a depth permitted by the means for continuously removing quench liquid, thereby forming a vertical wall of quench liquid on the inner side of the housing under the action of centrifugal force. The simultaneous addition of quench liquid at one end of the liquid retention volume and removal at the other end produces a flow or current of quench liquid. The spinner disk is also rotated, either independently of the housing or, preferably, at the same rate by being integrally joined to the quench chamber at the rotational axis. Once a steady state quench liquid flow is achieved in the quench chamber, liquid metal from the source metal supply tube is deposited onto the central protruding portion or tip of the spinner disk, and moves by laminar flow from the tip of the disk toward the periphery. As the laminar flow of metal approaches the periphery of the disk, the liquid metal is spun away, preferably as individual droplets, but also possibly as ligaments or films, depending upon the dimensions and rotational rate of the disk. The liquid droplets then fly outwardly to impact the surface of the flow of quench liquid, penetrate the quench liquid, and are thence solidified rapidly. The solidified particles flow with the quench liquid out of the housing and into an external recirculation system wherein the metal particles are separated from the quench liquid for further processing, and the quench liquid is then recycled back through the apparatus.

Although the basic apparatus itself works well for a wide variety of dimensions and operating conditions, in a preferred embodiment the geometry and dimensions of the system are optimized for the high rate production of rapidly quenched metal particles. In the preferred embodiment, the diameter of the spinner disk is about 6.4 centimeters, the inner diameter of the housing is about 10.2 centimeters, and the depth of the quench liquid layer is fixed at about 3 millimeters by positioning a quench liquid removal tube about 3 millimeters above the inner surface of the quench chamber. In this preferred embodiment, the shape of the upper surface of the spinner disk is important in ensuring that the flow of liquid source metal from the supply tube is laminar along the upper surface of the disk, so that the liquid does not break into droplets before reaching the periphery of the disk. In this preferred embodiment, the shape of the upper surface of the disk is expressed by the formula $y=0.6\times^2$, where x is the radial dimension measured from the outer periphery of the disk toward its center, and y is the height of the surface of the disk, both measured in inches. The shape defined by this equation may be approximated by a machined radius. The spinner disk and housing are preferably rotated at a rate of from about 10,000 to about 20,000 revolutions per minute. In the preferred embodiment of the apparatus, operating under these conditions, the liquid source metal flow remains laminar across most of the surface of the disk. The edge of the spinning disk is in close proximity to the quench liquid, so that the droplet travels only about 1.3 centimeters before impacting the surface of the quench liquid.

Because of the short time of flight from the periphery of the spinner disk to the surface of the quench liquid, there is insufficient time for the droplet to assume a spherical shape. Typically, the larger drops solidify as irregular platelets having at least one relatively thin dimension, while smaller particles are more nearly spherical. Particles having relatively large mass may be solidified under cooling rates of $10^{7}$° C. per second or greater. While the geometry of the particles is controllable by varying the operating conditions of the apparatus, such as the distance between the outer periphery of the disk and the surface of the quench liquid, for subsequent compaction processing into large parts the platelike particles are preferred because of their better packing density. Large particles are also particularly desirable because surface-related contamination is reduced, as compared with small particles. A variety of quench liquids may be utilized, including water, water containing chemical additives, liquid gases such as liquid nitrogen, and liquid metals.

It will be appreciated from the foregoing that the present invention represents an important advance in the field of apparatus for continuously preparing rapidly solidified metal particles. With this apparatus, large quantities of particles of a controllable shape are prepared. The apparatus may be utilized as part of a continuous production operation wherein the particles are prepared and then processed immediately or packaged for subsequent processing. Other features and advantages of the present invention will become apparent from the following more detailed description, taken in conjunction with the accompanying drawings, which illustrate, by way of example, the principles of the invention.

Figure 8:
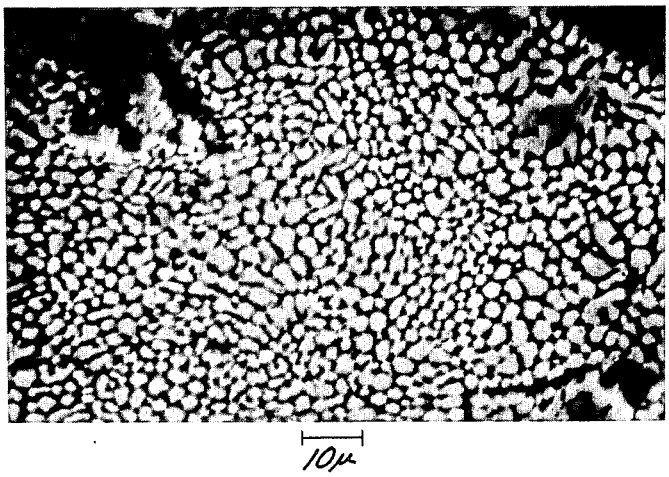
Figure 9:
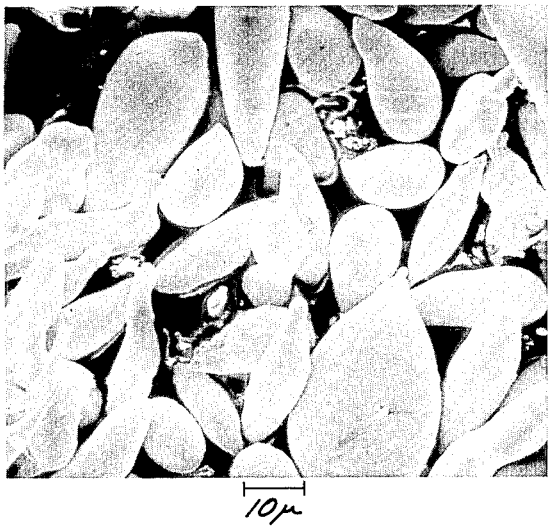

FIGS. *7a, b,* and *c* are side sectional views of three configurations of spinner disks;

FIG. 8 is a scanning electron micrograph of the microstructure of an 1100 aluminum alloy rapidly solidified using the apparatus of the present invention; and FIG. 9 is a scanning electron micrograph of palladium-silicon particles rapidly solidified using the apparatus of the present invention.

DETAILED DESCRIPTION OF THE PREFERRED EMBODIMENT

Figure 1:
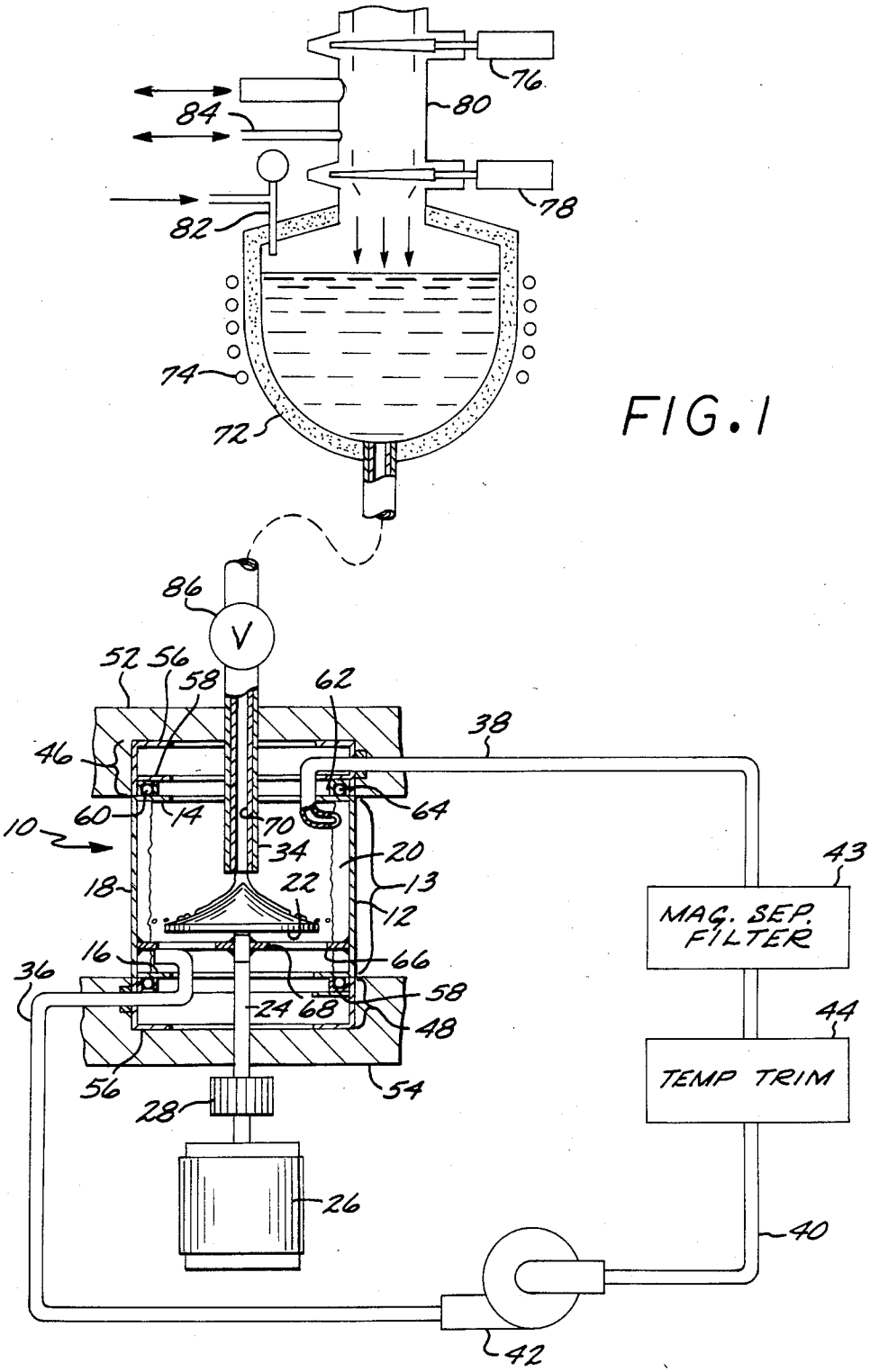
FIG. 1 is a partially sectioned side view of a presently preferred embodiment, together with a schematic block illustration of an external recirculation system.

As is shown in the drawings with reference to a preferred embodiment of the invention, and particularly as shown in FIG. 1, the present invention is embodied in an apparatus 10 for continuously preparing rapidly cooled metal particles from a molten source metal by quenching into a quench liquid. This basic apparatus is readily incorporated into automated devices for melting pieces of source metal, preparing the metal particles, and packaging the metal particles.

In accordance with the present invention, the apparatus 10 for preparing metal particles from a molten source metal by quenching into a quench liquid includes a generally cylindrical housing 12 having a provision for mounting to a support structure, and a cylindrical quench chamber 13 in which the particles are solidified. The quench chamber 13 is mounted for rotation about its cylindrical axis and includes an upper flange 14 and a lower flange 16 extending inwardly from the opposed ends of a wall 18, thereby defining a liquid retention volume 20. As the quench chamber 13 is rotated about its cylindrical axis, liquid is retained against the inside surface of the wall 18 of the housing 12, and within the liquid retention volume 20, under the action of centrifugal force. A spinner disk 22 is mounted within the housing 12 on a spinner disk axle 24, whose axis coincides with the cylindrical axis of the quench chamber 13. Thus mounted, the quench chamber 13 and the spinner disk 22 can be rotated by a motor 26 acting through a coupling 28.

Figure 2:
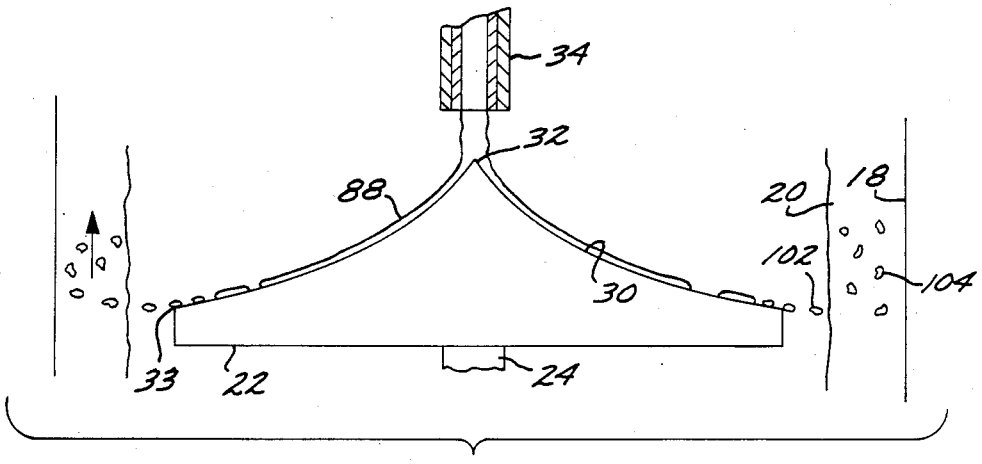
FIG. 2 is a detail view of a portion of FIG. 1, illustrating the spinner disk.

An upper surface 30 of the spinner disk 22 is not flat or dished inwardly, as in conventional spinner disks, but instead protrudes outwardly from the body of the spinner disk 22 to a generally conical protruding tip 32 coincident with the axis of the spinner disk axle 24. A conical portion 35 of the upper surface 30 may extend to an outer periphery 33 of the disk 22, as illustrated in FIGS. 1, 2, and *7a*. Alternatively, and as illustrated in FIG. *7b*, the conical portion 35 may extend only part way from the tip 32 to the periphery 33, so that the upper surface 30 is shaped as a central conical portion 35 surrounded by an annular flat portion 37 extending to the periphery. In yet another alternative illustrated in FIG. *7c*, the upper surface may be raised slightly adjacent the periphery 33, to form a dished portion 39 adjacent the periphery 33. In operation, liquid metal flows from a source metal supply tube 34 onto the upper surface 30 of the spinner disk 22 and thence outwardly in a manner to be described.

The quench liquid is provided to the quench chamber 13 by a supply means, preferably a quench liquid supply tube 36 which delivers quench liquid to the lower end of the interior of the housing 12 and into the liquid retention volume 20. Quench liquid is removed from the upper end of the housing 12 by a removing means, preferably a quench liquid removal tube 38, thereby producing a continuous flow of quench liquid through the liquid retention volume 20, from the lower end of the quench chamber 13 toward the upper end and thence out of the housing 12.

The quench liquid and any metal particles contained therein pass from the quench chamber 13 to an external recirculation system 40. The recirculation system 40 includes a pump 42 for externally pumping liquid from the removal tube 38 back to the supply tube 36 and thence around the recirculation system 40. Additionally, a particle separator 43 is included in the recirculation system 40 to remove the solidified particles from the liquid. The particle separator 43 may be a filter, a magnetic device if the metal particles are magnetic, a cyclone, or other appropriate separation means. If the quench liquid is volatile, such as a liquified gas or water, the particles can be separated by evaporating the quench liquid. Also included in the recirculation system 40 is a temperature trim unit 44 which, during extended continuous operation of the apparatus 10, removes heat from the quench liquid to maintain a relatively constant temperature of the quench liquid within the apparatus 10.

Turning to a more complete description of each of the operating elements of the apparatus 10, the housing 12 includes a stationary upper end cap 46, a stationary lower end cap 48, and the rotatable quench chamber 13. The upper end cap 46, lower end cap 48, and quench chamber 13 are all cylindrical in shape, of the same cylindrical diameter, and located on a common cylindrical axis.

The upper end cap 46 is mounted in an upper mounting 52, which supports and holds stationary the upper end cap 46. Similarly, the lower end cap 48 is mounted in a lower mounting 54 which supports and holds stationary the lower end cap 48. The mountings 52 and 54 include appropriate passageways therethrough to accommodate various feedthroughs, as will be described.

The construction of the upper end cap 46 and the lower end cap 48 is generally similar, each being a short cylinder having an axial length less than the cylindrical diameter. Each cap 46 and 48 has a cap end flange 56 remote from the quench chamber 13, for strengthening and attachment purposes. Each end cap 46 and 48 also includes an internal annular rib 58 projecting inwardly from the inner wall of the cap. The annular rib 58 strengthens the cap, and additionally provides a support and attachment surface for a quench chamber bearing support means, preferably a pair of bearings 60. Each bearing 60 is preferably of the ball bearing type, with a bearing race 62 having an outer diameter dimensioned so that the race 62 fits within the inner diameter of the respective end cap 46 or 48. The race 62 faces inwardly toward the rotatable quench chamber 13. A plurality of ball bearings 64 roll within the race 62, and contact and support the rotatable quench chamber 13 portion of the housing 62, through contact with the outer surface of the upper and lower flanges 14 and 16.

The present invention contemplates that the spinner disk 22 and the quench chamber 13 may rotate independently, or in the preferred embodiment, that the spinner disk 22 and the quench chamber 13 are connected by a spider 66 which is welded to the spinner disk axle 24 and the inner wall of the quench chamber 13. The spider 66 is a flat plate having a series of openings 68 therethrough. The outer extent of the openings 68 allows quench liquid to pass through the holes to flow upwardly from the quench liquid supply tube 36 toward the quench liquid removal tube 38. With this preferred embodiment of the invention incorporating the spider 66, the one motor 26 drives both the spinner disk 22 and the quench chamber 13 in the same rotational direction and at the same rotational rate.

Liquid source metal is supplied to the interior of the apparatus 10 through the source metal supply tube 34, which is preferably a steel tube having a ceramic lining 70. The supply tube 34 is conveniently positioned to discharge liquid metal vertically downwardly onto the center of the protruding tip 34 of the spinner disk 22, so that the metal flow divides and flows along the upper surface 30.

The source metal may be supplied to the supply tube 34 by any convenient source, but a preferred approach is illustrated in FIG. 1. In the preferred approach, a ceramic crucible 72 is charged with the source metal. The source metal is heated in the crucible 72 by an induction coil 74 which is wrapped around the crucible 72. The crucible 72 is airtight, and its contents are sealed from contact with the atmosphere by a pair of valves, including an upper valve 76 and a lower valve 78, the space between the valves 76 and 78 defining a lock 80. Molten metal is forced out of the crucible 72 and into the supply tube 34 by gas pressure introduced to the space above the metal through a pressure line 82. Additional metal to be melted may be added into the crucible 72 without discontinuing operations by maintaining the gas pressure from the pressure line 82, and adding metal through the lock 80. To add metal, the upper valve 76 is opened, metal is added to the lock 80, the upper valve 76 is closed, the lock 80 is pressurized by lock pressure line 84 to the same pressure as within the crucible 72, and then the lower valve 78 is opened to admit the metal pieces to the crucible 72. The rate of flow of liquid metal in the supply tube 34 may be regulated by a liquid metal valve 86 in the tube.

FIG. 2 illustrates the preferred flow pattern of liquid source metal from the supply tube 34 over the surface of the spinner disk 22 and into the liquid lying within the liquid retention volume 20. Liquid metal flowing out of the supply tube 34 is deposited upon the rotating apex of the tip 32 of the upper surface 30 of the spinner disk 22. The metal flow then divides to flow downwardly and outwardly over the upper surface 30 as a laminar flow 88. This laminar flow 88 is highly preferable to the premature breaking up of the metal mass into droplets 102 before reaching the periphery 33 of the spinner disk 22, since droplets cool much more rapidly by conduction or radiation than does a laminar flow.

Maintaining a smooth, laminar flow 88 over the upper surface 30 of the spinner disk 22 is important in obtaining the greater quenching rates possible with the present apparatus. It is desirable that the droplets 102 be formed shortly before impacting into the quench liquid, since the cooling rate of the droplet in the quench liquid is much greater than in air or vacuum. It is also expected that the liquid metal will cool more rapidly as a droplet than as a laminar stream, due to the greater surface area per unit volume of the particles. The present apparatus therefore strives to delay the breakup of the laminar flow 88 into droplets until the liquid metal approaches the periphery 33 of the spinner disk 22.

Figure 7:
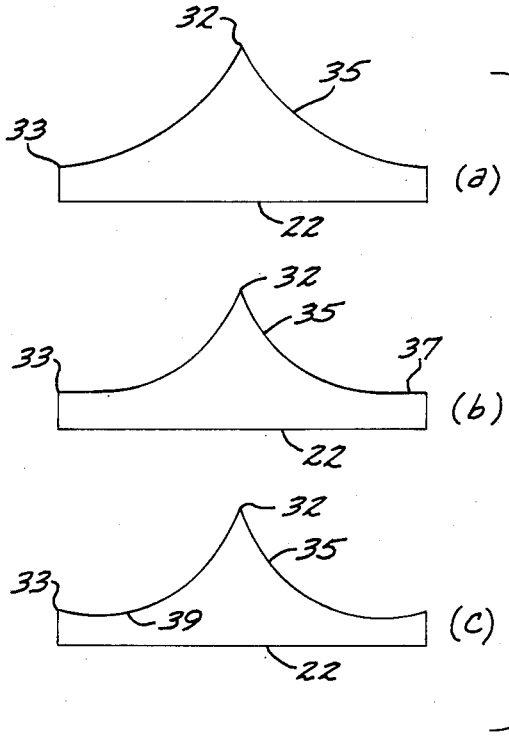

The various designs for the spinner disk 22 illustrated in FIGS. 2 and 7 achieve such a delayed formation of droplets 102, since the tip 32 serves to divide the liquid metal flowing from the supply tube 34 into a smooth laminar flow 88. The laminar flow 88 continues as the liquid metal stream flows outwardly, and the velocity of the liquid metal is turned through 90° from vertically downward to outward, in the view of FIG. 2. It is not necessary that the formation of droplets 102 from the laminar flow 88 be accomplished precisely at the outer periphery 33, but instead the point of droplet formation can be adjusted by varying the precise shape of the upper surface 30. As an example, a more spherical particle may be obtained at the expense of a slightly lower cooling rate by using a compound surface such as illustrated in FIG. 7*b*, wherein the droplets are formed closer to the radial center of the spinner disk 22, as compared with FIG. 7*a*. With the earlier formation of the droplets 102, surface tension forces have a longer period of time to reshape the droplets into a spherical form, but in addition there is greater cooling of the droplets prior to impacting the quench liquid. Nevertheless, the maintaining of a laminar flow over the surface of the disk significantly improves the quenching rate that is achievable.

The present approach to the design of the spinner disk is to be contrasted with the prior approaches. Conventionally, the spinner disk is provided as a flat plate or a dished cup. In such designs, the downward flow of metal from the supply tube becomes turbulent upon striking the upper surface of the spinner disk, so that droplet formation is initiated very quickly. The droplets thus formed also reside on the spinner disk for a greater period of time before being spun outwardly into the quench liquid, since they have no radial velocity component immediately upon striking the surface of the flat spinner disk.

Returning to the present approach, the liquid metal supplied from the supply tube 34 should preferably have a temperature of about 100° C. to about 150° C. above the liquidus temperature of the alloy. For the viscosity levels typically present in liquid metals, the lowest viscosity alloys present the most difficult conditions for rapid solidification. To maintain the desired laminar flow from the supply tube 34 to the tip 32 and thence outwardly across the upper surface 30, it is preferable to maintain the distance between the bottom of the supply tube 34 and the point of the tip 32 to be about 2 centimeters or less. The preferred inner diameter of the supply tube 34 is about 1.5 to about 2.5 millimeters, and the differential pressure in the supply tube 34 as compared with the ambient environment preferably varies from about 1 to about 5 psi, most preferably in the range from about 1 to about 2 psi. To cite a specific example, at a nozzle-totip distance of 1.5 millimeters and a 2 psi pressure differential, a smooth laminar flow of about 0.45 liters per minute is obtained.

After leaving the spinner disk 22, the droplets 102 travel a short distance outwardly before striking the surface of the quench liquid in the liquid retention volume 20. As indicated by the upward arrow in FIG. 2, the quench liquid flowing from the supply tube 36 to the removal tube 38 produces a vertically upward current of quench liquid, so that as the droplets 102 are solidified by their contact with the quench liquid, the droplets form solid particles 104 which are swept upwardly along with the current of the quench liquid. This current then moves the particles to the removal tube 38, for removal from the apparatus 10. The depth of the quench liquid in the liquid retention volume 20 should be sufficiently great that the particles 104 do not penetrate the liquid to the wall 18, to ensure that the particles 104 do not adhere to the wall 18, which would cause a disruption of the flow of quench liquid. A depth of the quench liquid of about 3 millimeters is usually sufficient.

The structure of the droplets 102 may be varied by the conditions of metal flow and rotation of the spinner disk 22. Where the droplets 102 are formed upon passing the periphery 33, the time of flight from the periphery 33 to the surface of the quench liquid in the retention volume 20 is thought to be less than about $10^{-3}$ seconds. During this short time of flight, the surface tension forces within the droplets 102 typically do not reshape the droplets 102 into a spherical form, so that the droplets 102 are shaped as liquid platelets having two relatively large dimensions, and one relatively small dimension for rapid extraction of heat in the quench liquid. Upon solidification, this shape is retained. This droplet and particle shape is preferred, inasmuch as the total volume of the resulting particle is much greater than the volume of a spherical particle of the same thickness in the minimum dimension. The cooling rates for the platelike particles are therefore comparable to those of spherical particles, having a diameter comparable with the minimum dimension of the platelet. The platelike particles may also have better packing efficiency when used in later compaction processes, as where the particles are placed in a mold and hot pressed into a useful article, where the particles are rolled, or where the particles explosively compacted. As described above, the configuration of the droplets 102 may be varied by changing the relative dimensions of the elements of the apparatus 10 and the operating parameters so that spheres, platelets, and other shapes may be produced as desired.

The quench liquid in the liquid retention volume 20 may be virtually any compatable liquid material. Quench liquids include, for example, water, water with added ingredients that aid in the rapid quenching of particles, liquid gases such as liquid nitrogen, and liquid metals of relatively low melting points. Water is the presently preferred quench liquid, because it is readily available, easily handled, and does not require special insulation in the apparatus 10, but water cannot be used with some reactive metals. The high flow rate of quench liquid and low temperature rise offer a high degree of safety, as in the quenching of aluminum into water.

Liquid gases and liquid metals offer special advantages which may justify the extra difficulties incurred in their use. (The use of a liquid metal as the quench liquid flowing in the retention volume 20 is distinguished from liquid source metal introduced through the source metal supply tube 34. The source metal is the metal solidified into particles, while the quench liquid which cools the solidifying source metal is ordinarily a different liquid metal, having a much lower melting point.) Where liquid gases and liquid metals are used as the quench liquids, the apparatus 10 must be insulated due to the low and high temperatures, respectively. Where liquid gases are utilized, there must be provisions to avoid overpressurization of the interior of the quench chamber 13. Liquid metals offer the special advantage of providing cooling without the formation of a vapor barrier at the surface of the droplets 102 and particles 104, thereby increasing the potential cooling rate. Additionally, liquid metals have greater densities than water and liquid gases, so that the particles 104 are more completely mixed into and dispersed within the quench liquid. This more complete dispersal allows uniform flow of the mixture of particles and quench liquid into the removal tube 38. A presently preferred liquid quench metal is a 70:30 alloy of tin and indium.

Figure 3:
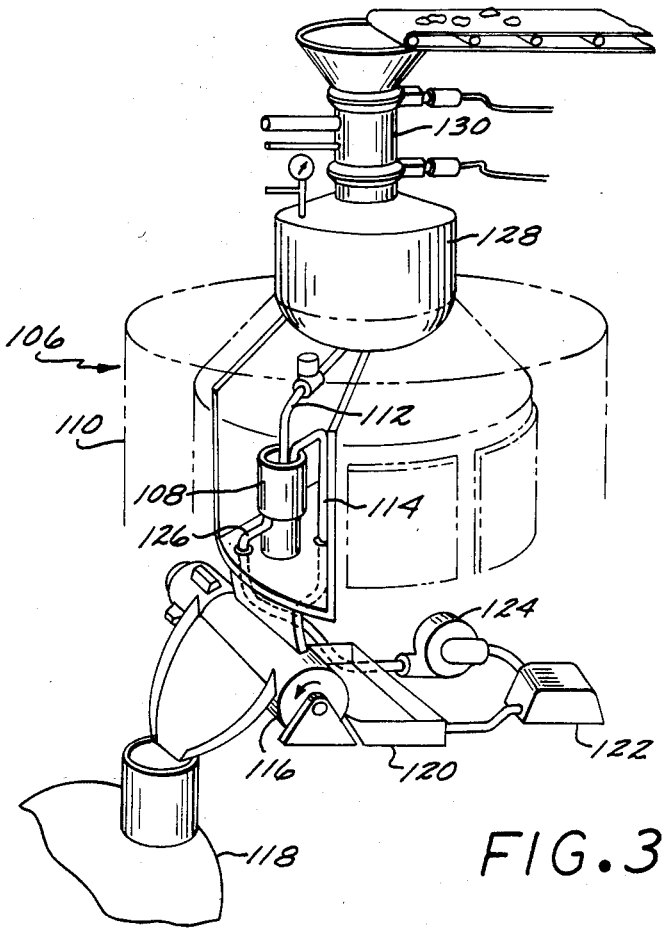
FIG. 3 is a perspective view of an integrated device for preparing metal particles using the apparatus of the present invention, in an inert gas atmosphere.
Figure 4:
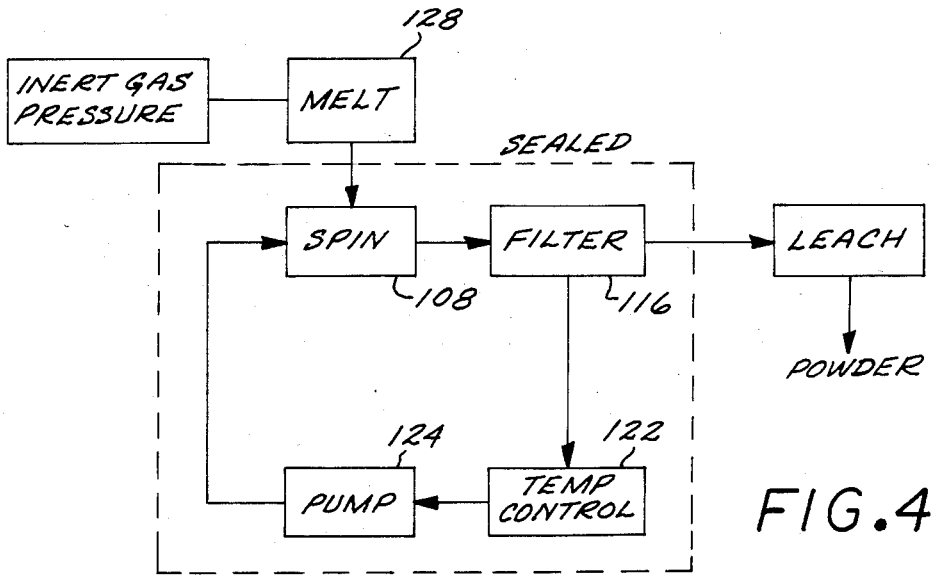
FIG. 4 is a schematic system block flow chart for the device illustrated in FIG. 3.

The apparatus 10 is particularly adaptable for use in continuous production devices for preparing large amounts of rapidly cooled metal particles. FIGS. 3 and 4 illustrate a particle production device 106 for producing metal particles under an inert gas atmosphere. In the device 106, particles are produced by apparatus 108 of the type described previously. The apparatus 108 is contained in a chamber 110 of sufficient air tightness to maintain the desired inert gas atmosphere within the chamber 110. Molten source metal to be processed into particles is supplied to the apparatus 108 through a supply tube 112 from a furnace 128. The mixture of quench liquid and particles is removed from the apparatus 108 through a removal tube 114 to a roll separator 116. In the roll separator 116, particles are separated from quench liquid as the particles are forced in the direction of roll movement (counter-clockwise in FIG. 3) to fall down a chute into a particle container 118. Quench liquid falls into a trap 120 (clockwise in FIG. 3) where the liquid is collected and recycled into a temperature trim unit 122 and then pumped by a pump 124 into a quench liquid supply tube 126 to be recirculated into the apparatus 108. Molten source metal is provided by the furnace 128 supplied with pieces of source metal through a lock 130. A single device 106 may conveniently include a plurality of apparatus 108 within a single chamber 110 to achieve increased particle production.

Figure 5:
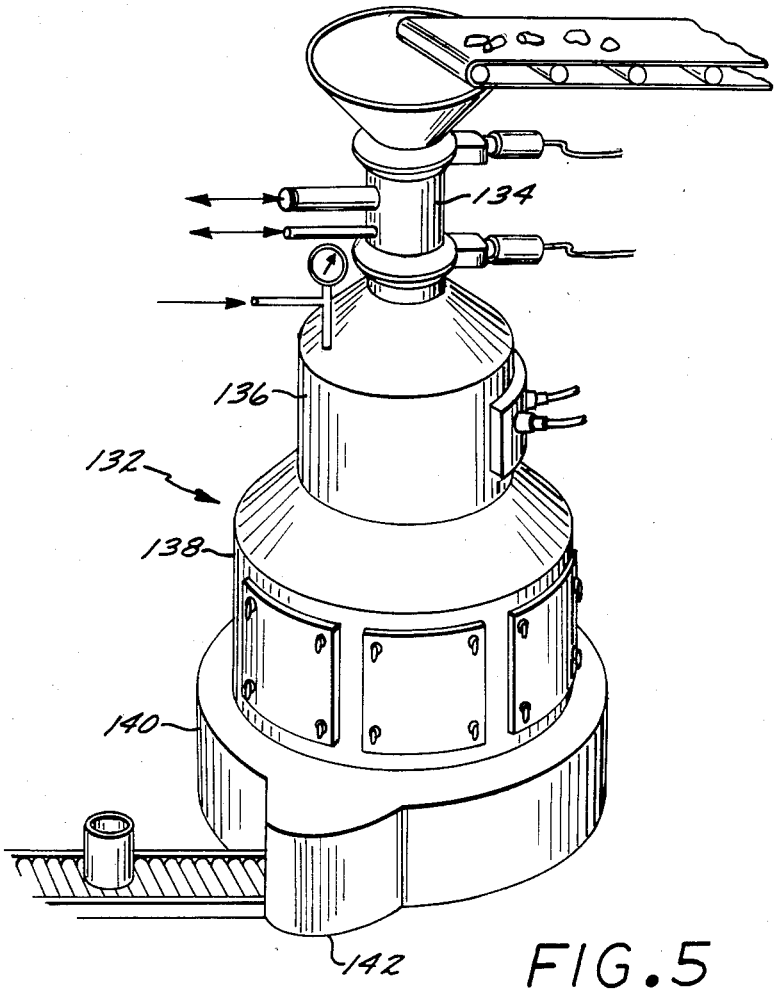
FIG. 5 is a perspective view of an integrated device for preparing metal particles using the apparatus of the present invention, in a vacuum environment.
Figure 6:
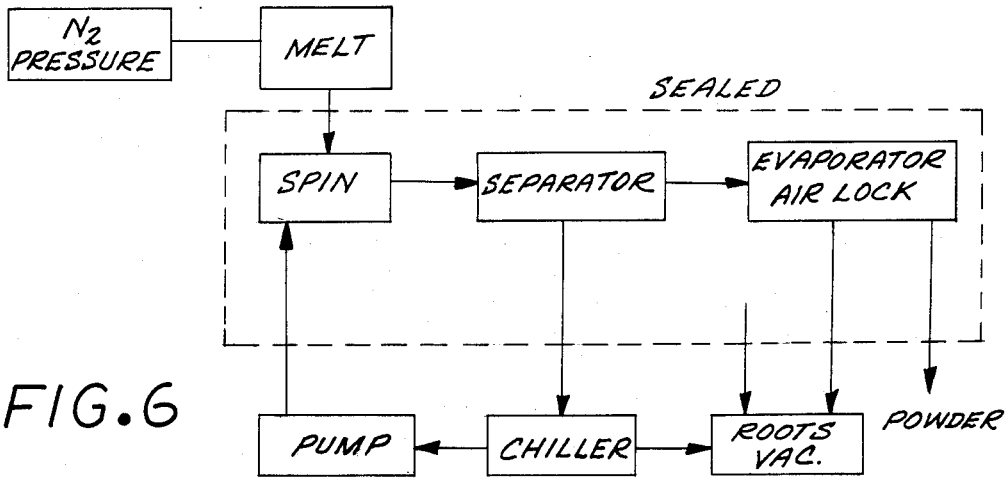
FIG. 6 is a schematic system block flow chart for the apparatus of FIG. 5.

FIGS. 5 and 6 illustrate another production embodiment of the invention, used to produce metal powder in a vacuum. As indicated in FIG. 6, the entire system is pumped with a vacuum pump, source metal pieces must be added through a vacuum lock, and finished particles of powder are removed through a vacuum lock. In this vacuum production device 132, pieces of source metal are added through a lock 134 into a furnace section 136. Molten metal is supplied to rapid solidification apparatus (not visible) of the type previously described, contained within the solidification section 138. The particles are removed from the apparatus in a stream of quench liquid, and are separated in a separation section 140, for packaging. Particles are removed through a vacuum lock 142 to retain the vacuum within the production device 132.

The following examples will serve to illustrate the apparatus of the present invention, but should not be taken as limiting the scope of the invention in any respect.

EXAMPLE 1

A sample of 1100 aluminum was melted and heated in the preferred apparatus to a temperature of about 725° C. The molten alloy was ejected through the supply tube under a pressure of 50 centimeters of mercury, the supply tube having a nozzle inner diameter of 1.5 millimeters and a placement 1.0 millimeter above the tip of the spinner disk. The disk was 4.4 centimeters in diameter and was rotated at 10,000 rpm. The environment was a vacuum of 74 centimeters of mercury. The quench liquid was water.

The resulting particles were flat, generally disk-shaped platelets having a grain size of approximately 2.5 micrometers, which indicates a cooling rate of approximately $4\times10^{7}$° C. per second. FIG. 8 is a scanning electron micrograph of one of the particles.

EXAMPLE 2

A sample of palladium-silicon alloy containing 5.83 percent by weight of silicon was melted and heated to approximately 1100° C. The molten alloy was ejected through a nozzle having an inner diameter of 1.5 millimeters placed 3 millimeters above the tip of the spinner disk, under a differential pressure of 10 psi. The spinner disk was 6.4 centimeters in diameter and rotated at 9000 rpm. The ambient environment was low pressure argon, and the quenchant was water. The resulting particles were in the shape of teardrops.

X-ray diffraction studies of the particles showed them to be completely amorphous, even for particles in the size range −80, +100 (Tyler sieve). The obtaining of an amorphous structure in such large particles is possible due to the greater quenching rate obtainable in the apparatus of the present invention. A scanning electron micrograph of the particles is shown in FIG. 9. Examples 1 and 2 were prepared using spinner disks having the configuration illustrated in FIG. 7*b*.

Thus, the present invention provides a highly versatile, economical and continuous apparatus for the preparation of rapidly solidified metal particles from source metal. Although a particular embodiment of the invention is described in detail for purposes of illustration, various modifications may be made without departing from the spirit and scope of the invention. Accordingly, the invention is not to be limited except as by the appended claims.

What is claimed is:

1. Apparatus for preparing metal particles from a molten source metal by quenching into a quench liquid, comprising:

a housing having a cylindrical hollow internal quench chamber, said quench chamber having an inwardly directed flange at each end thereof to define a liquid retention volume for holding a quench liquid, said quench chamber being rotatable about its cylindrical axis;

a spinner disk within said housing having an upper surface and a generaly conical protruding portion forming at least a part of the upper surface, said spinner disk being rotatable on the same axis as said quench chamber;

a source metal supply tube positioned to deposit molten source metal substantially in the center of the upper surface of said disk, whereupon the molten source metal is thrown outwardly into the quench liquid;

means for supplying the quench liquid to said liquid retention volume of said housing at one end thereof; and means for continuously removing quench liquid and solidified particles mixed with said quench liquid from the other end of the liquid retention volume.

2. The apparatus of claim 1, wherein the quench liquid is a liquid metal.

3. The apparatus of claim 2, wherein the liquid metal is an alloy of tin and indium.

4. The apparatus of claim 1, wherein said housing and said spinner disk are fixedly joined together, so that both rotate at the same speed.

5. The apparatus of claim 1, wherein the upper surface of said disk has a dished portion therein.

6. The apparatus of claim 1, wherein the upper surface of said disk is continuously curved.

7. The apparatus of claim 1, wherein the upper surface of said disk includes a curved portion and a flat annular portion.

8. The apparatus of claim 1, wherein the diameter of said disk is from about 3 to about 10 centimeters.

9. The apparatus of claim 1, wherein said means for continuously removing includes an open ended removal tube contacting the surface of the quench liquid so that a pump may draw quench liquid and solidified particles into said removal tube.

10. The apparatus of claim 1, wherein said means for supplying includes a supply tube having a discharge end positioned immediately below the level of quench liquid defined by said means for continuously removing.

11. The apparatus of claim 1, further including means for recirculating quench liquid from said means for continuously removing to said means for supplying.

12. The apparatus of claim 11, wherein said means for recirculating includes a pump for drawing quench liquid and solidified particles into said means for continuously removing and pumping the quench liquid to said means for supplying thereby forming a recirculation loop, and means for separating the solidified metallic particles from the quench liquid, said means for separating being within said recirculation loop.

13. The apparatus of claim 1, further including a vacuum chamber enclosing said apparatus.

* * * * *